US010540827B1

(12) United States Patent
Jones, Jr.

(10) Patent No.: US 10,540,827 B1
(45) Date of Patent: Jan. 21, 2020

(54) DIGITAL CHESS CLOCK DISPLAYING CALCULATED PLAYING SPEED

(71) Applicant: Royal Clifford Jones, Jr., Narragansett, RI (US)

(72) Inventor: Royal Clifford Jones, Jr., Narragansett, RI (US)

( * ) Notice: Subject to any disclaimer, the term of this patent is extended or adjusted under 35 U.S.C. 154(b) by 0 days.

(21) Appl. No.: 15/257,531

(22) Filed: Sep. 6, 2016

(51) Int. Cl.
*G07C 1/28* (2006.01)
*A63F 3/00* (2006.01)
*G04F 10/00* (2006.01)

(52) U.S. Cl.
CPC ..... *G07C 1/28* (2013.01); *A63F 3/00895* (2013.01); *G04F 10/00* (2013.01); *A63F 2250/1084* (2013.01)

(58) Field of Classification Search
CPC ... G04F 10/00; G07C 1/28; A63F 2250/1084; A63F 3/00895
See application file for complete search history.

(56) References Cited

U.S. PATENT DOCUMENTS 4,062,180 A 12/1977 Meshi et al.
4,079,583 A 3/1978 Larsen
4,472,067 A 9/1984 Richardson et al.
4,884,255 A 11/1989 Fischer
4,993,004 A * 2/1991 Loizeaux ..... G04F 10/00 368/107
5,420,830 A 5/1995 Camaratta, Jr. et al.
5,642,334 A * 6/1997 Liberman ..... G04F 5/025 368/10
5,796,680 A 8/1998 Franklin
6,104,674 A 8/2000 Emoff et al.
7,887,232 B1 2/2011 Jones, Jr.
2001/0034256 A1* 10/2001 Green ..... G04F 1/005 463/1
2002/0093882 A1 7/2002 Garlock
2003/0026172 A1 2/2003 Eagle
2004/0145114 A1 7/2004 Ippolito et al.

OTHER PUBLICATIONS

Royal C. Jones, Jr.,"The Minimum-speed Game Timer Manual for the Simulation," last modified Aug. 16, 2016, http://www.msgt.info/MSGT.pdf.

* cited by examiner

*Primary Examiner* — Edwin A. Leon
*Assistant Examiner* — Jason M Collins

(57) ABSTRACT

A game timer, suited in some embodiments as a chess clock, designed to calculate and display minimum average playing speed in moves per unit time over a sequence of one or more time controls based on input for number of moves in each time control, time allotted at the start of each time control, whether or not a delay applies to the moves of a particular time control, and time of the delay. In addition to these inputs, calculation of minimum average playing speed takes into consideration whether a delay comes before or after a move, whether or not a delay constitutes time available in the current time control, shortening of delays by players in the course of a game, and time remaining at the end of a time control. One embodiment estimates playing speed for "sudden death" over an entire game.

12 Claims, 16 Drawing Sheets

DIGITAL CHESS CLOCK DISPLAYING CALCULATED PLAYING SPEED

CROSS-REFERENCE TO RELATED APPLICATIONS

This application is related to application Ser. No. 12/583,440, filed Aug. 20, 2009, now U.S. Pat. No. 7,887,232, granted Feb. 15, 2011, the entire content of which is hereby incorporated herein by reference.

FEDERALLY SPONSORED RESEARCH

Not Applicable

SEQUENCE OR PROGRAM

Not Applicable

BACKGROUND—PRIOR ART

Mechanical timers came into use for chess tournaments in the late 1800's, replacing sandglasses. A chess clock, as it is now called, actually comprises a pair of clocks running alternately. Each clock is controlled by a switch, usually in the form of a pushbutton, which stops the clock on the side of the player who is completing a move and simultaneously starts the clock of the player whose turn it is to move. To start a game the player with the black pieces (Black) pushes the move button on his/her side, thereby starting the clock of the player with the white pieces (White), who makes the first move of the game. Each clock by this means records the cumulative time taken by each player in the sequence of his/her moves. The players are required to complete a specified number of moves within an initially allotted time, known as a time control, on pain of forfeit. There may be a plurality of time controls, basically subsequences of the sequence of moves by each player, with a varying number of required moves and time periods. The overall timing scheme is herein called a time limit, although usage varies.

The traditional time limit known as "forty in two" will serve as an example. It includes a primary time control of 40 moves in two hours, a secondary time control of 20 moves in one hour, and sometimes a tertiary time control of 10 moves in 30 minutes. The final time control in the series is repeated to the end of the game. Time left over on a player's clock at the end of a time control is added to his/her next time control. Players are usually responsible for keeping track of the number of moves completed by recording moves in chess notation.

The speed at which moves are made may vary considerably from long, drawn out moves in a complex position to split-second moves in time trouble. The playing speed enforced by a time control is called an average speed in mathematics, which may be written $$S=M/T, \tag{1}$$

where M is the required number of moves and T is the allotted time. S is in terms of moves per hour or, for speed chess, moves per minute. It is clear from this formula that if a player fails to complete the required number of moves in the allotted time, his/her average playing speed when the forfeit occurs will be less than the minimum imposed by the time control. Hereafter in this application for the sake of brevity playing speed may be taken to mean minimum average playing speed. In the time limit of the example above, the designation "forty in two" adequately describes the requirements of the first time control. It is easily established that the playing speed is 20 moves per hour and, furthermore, that the playing speed of the second and third time controls is also 20 moves per hour.

The above mathematical description of time controls is not current in chess circles, where such controls are regarded primarily as a means of expediting play. "Forty in two," for example, is rarely described as 20 moves per hour. Playing speed in general has come to be a neglected concept with the advent of digital time limits, especially because it is now more difficult to calculate it with precision.

Advances in Timing Technology

In the 1970's electronic digital chess clocks (usually powered by batteries) emerged. The first commercially available digital chess clock was patented by Joseph Meshi in 1975 (U.S. Pat. No. 4,062,180). Digital chess clocks make possible variations in timing, in particular, delays or increments, intended to make enforcement of time controls more flexible. Time controls continued to be described in terms of a required number of moves over a period of time. Delays and increments were considered negligible in time controls, and it was not generally recognized that they affect playing speed. Before describing these effects, it will be useful to review the three major delay schemes that are enabled by digital clocks.

The Fischer Clock

The problem of time scrambles (i.e., frantic attempts to avoid a forfeit on time) was addressed by a 1988 invention of Robert J. Fischer (U.S. Pat. No. 4,884,255), known as the Fischer Clock. The mechanism of the Fischer Clock adds a predetermined amount of time, typically one or two minutes, to a player's remaining time for every move that he/she completes. The additional time, called a bonus or increment, was intended as a reward for completing moves with dispatch. As Fischer pointed out in his patent application:

> If a 2-minute interval is selected, a player will always have [the original time] remaining on his clock if that player spends exactly 2 minutes on every single move during the game. For each move that a player spends less than 2 minutes, he will accumulate additional time on his clock for use on future moves. For each move that a player spends more than 2 minutes, a player will use up some of his stored up time from either previous moves or from his initial time period.

This scheme usually has the intended effect of avoiding time scrambles, but the effect on playing speed was never made clear.

Time Delays

Another method for avoiding time scrambles is embodied in digital game timers with a move delay (U.S. Pat. No. 5,420,850 to Cameratta et al., 1995). When a player completes his/her move on such a timer, the opponent's clock does not start immediately. There is instead a slight delay, typically five seconds, considered free thinking time for the player on the move. The idea is that a player will always have, at a minimum, the period of the delay to complete his/her move. This delay, like the Fischer increment, allows extra time for deliberation. However, the Fischer increment is added after a move is completed while the simple delay occurs at the start of a move. A simple delay never causes time to be added to a clock display. Any unused portion of the delay when a player moves quickly is simply discarded.

Time delays over the course of a game distort the intended playing speed. Official rules of the United States Chess Federation (USCF) once provided that "the tournament director has the right to shorten the basic time control" in compensation for move delays (Fifth Edition, Rule 5Fa).

However, this rule has recently been deleted: "All clocks, including digital, delay, analog, are to be set for the same base (starting) time" (www.uschess.org, Rulebook Changes, 2003-2014). The effect of move delays on playing speed, in short, is to be ignored.

The Bronstein Clock

The oldest of the timing schemes was introduced by Soviet grandmaster David Bronstein (1924-2006). It is like the Fischer Clock in that time is added to a player's clock at the completion of each move, but with the Bronstein Clock the time added is never greater than the time spent on a move. Consequently, there may be no net change on the clock at the completion of a move, and one does not see the expanding time control that often occurs in the Fischer Clock. The Bronstein delay (or increment) is similar in effect to a simple delay, and USCF rules consider the two equivalent (Rule 5F: Tip). However, the fact that the Bronstein delay comes after the move, while the simple delay occurs at its beginning, requires different handling at the beginning and end of a time control. Once again the primary concern is to avoid time scrambles. There has been no analysis, to my knowledge, of the precise effect on playing speed.

Displaying Playing Speed

The delays and increments which modify the operation of a game timer were primarily intended as means of dealing with time scrambles. It was never considered necessary to calculate their timing effects precisely, and the fact that they do not alter initially allotted time reinforced this impression. Modifications of timing nevertheless have an effect on the total elapsed time in a time control, denoted in Formula 1 as T, and consequently on playing speed, S. (Such modifications will hereafter simply be termed delays since both delays and increments have the effect of augmenting total time.) Chess clocks display the time remaining on each side and sometimes (in digital versions) the number of moves remaining in a time control. But playing speed is an essential aspect of time limits, and its display would be a valuable feature in modern timers.

Sudden Death

The tendency to neglect playing speed in chess clocks was no doubt exacerbated by the introduction in recent years of a time control known as sudden death. A sudden-death time control specifies a period of time in which a game is to be completed, that is, either an entire game (Game/SD) or the portion remaining after one or more normal time controls. The number of moves required is indeterminate. Since a sudden-death control, if one is included in a time limit, must be the last in a series of time controls, it may be said to govern a terminal subsequence of moves. It thus facilitates the scheduling of games in large amateur tournaments, but it makes the precise calculation of playing speed difficult. There is, however, a way to estimate playing speed in sudden death, at least for Game/SD, as will be shown.

When there is a definite number of moves required in a time control, it governs a nonterminal subsequence of moves. In the absence of a sudden-death control, the last time control in a series of nonterminal controls repeats itself indefinitely with respect to the period of time and the number of moves in the subsequence.

Playing Speed as Input

In a previous invention by this applicant (U.S. Pat. No. 7,887,232, issued 2011) minimum average playing speed was presented as an input value. Playing speed was entered by the user into the timer, along with other values, to obtain a starting time. A problem with this approach is that playing speed is not ordinarily dealt with in chess practice, and it is a value that in many cases would not be easy for the average chess player to calculate.

SUMMARY

Embodiments of the contemplated timer include a display of minimum average playing speed calculated from inputs to the timer in the form of buttons, knobs, switches, or other appropriate means (note that a working model of the timer is currently maintained by me at http://www.msgt.info/). Internal calculations are based on the formulas presented herein. If each move in a normal time control includes a delay d, the maximum time consumed by a time control is $$T=I+dM, \tag{2}$$

where I is initial time and M is the number of moves. T is calculated internally in seconds but is represented in units of time u either as hours or minutes, that is, either u=3600 or u=60. Since it divides the denominator, the unit of speed is moved to the numerator in the formula for playing speed:

$$S=\frac{uM}{I+dM}. \tag{3}$$

For both simple and Bronstein delays, the time of delays may be shortened in actual play, usually because of time pressure. The effect of these shorter delays is to increase playing speed, as may be judged from Formula 3. The formula nevertheless represents minimum average playing speed, as d represents the full delay in seconds.

Care must be taken to assure that the assumption of a delay associated with each move holds true. In the case of Fischer or Bronstein delays, the final delay in a time control is effectively lost for that control because a player must complete the final move of the control before the delay is added to available time. One embodiment of the timer under consideration provides an efficient remedy by including a delay at the start of a time control, which maintains the validity of Formula 3. In effect, the final Fischer or Bronstein delay is transposed from the end of a time control to its start. If a specific starting time is required, such as for the official time limit of a tournament, the initial delay is assumed to be included in the starting time that is entered as input, in which case the initial delay is said to be implicit. The inclusion of an initial delay is not necessary in the case of a simple delay because it comes at the start of a move, and the final simple delay in a time control comes before completion of the final move.

Once playing speed has been calculated from the number of moves in the primary time control and other input data, any subsequent nonterminal time controls must be consistent with that playing speed, which is assured by calculating the initial time of the subsequent control. The initial time of a nonterminal time control (i. e., other than sudden death) follows from Formula 3 as $$I=\left(\frac{u}{S}-d\right)M, \tag{4}$$

where initial time does not include any transposed delays and therefore is not always equivalent to starting time. For time controls with Fischer or Bronstein delays, starting times include an initial delay (I+d). Since unused time carries over from one time control to the next, Formula 4 provides consistency of playing speed over a series of nonterminal time controls. If time remains upon completion of the last control in the series, overall playing speed at that point will be greater than the minimum specified by Formula 3, but with competitive time pressure it will tend toward the minimum.

Some input configurations produce untenable states of the timer, essentially error conditions. These are addressed in some embodiments by automatic adjustments of starting time. For example, if the input starting time is less than the initial delay required by a Fischer or Bronstein delay (I+d<d), starting time is automatically set to the value of the initial delay, which avoids a negative initial time.

In some embodiments time controls may be selected to have their moves either include or omit the input move delay. If a nonterminal primary time control is selected to omit move delays and a subsequent nonterminal time control is selected to include move delays, there is the possibility of a negative initial time by Formula 4 after the primary control. This possibility is avoided by an adjustment of starting time based on the following logic:

Without an initial delay, playing speed by Equation 3 in the primary time control is reduced to $$S = \frac{uM}{I}. \tag{5}$$

To avoid a negative value for initial time by Formula 4 in subsequent time controls, the maximum value for the delay is seen to be u/S, from which it follows that S Substituting for S by Formula 5, $$\frac{uM}{I} \leq \frac{u}{d}, \tag{6}$$

and $$I \geq dM. \tag{7}$$

If this minimum value for I is not met, the starting time (I in this case) is set to dM, which avoids negative values of I throughout the time limit. Note that the minimum does not apply where there is no subsequent nonterminal time control that includes a delay, for example, in the case of a sudden-death secondary control.

As a practical matter, some embodiments limit the range of playing speeds by automatically adjusting the input starting time if necessary. The minimum playing speed allowed in one embodiment is 1 move per hour, and the maximum is 60 moves per minute. By substituting these values for the term u/S in Equation 4, one obtains limiting values for initial time, I. Thus, at the fastest playing speed permitted, u=60 and S=60, giving $$\frac{u}{S} = 1, \tag{8}$$

and $$\min(I) = (1-d)M. \tag{9}$$

At the slowest speed allowed, u=3600 and S=1, giving $$\frac{u}{S} = 3600, \tag{10}$$

and $$\max(I) = (3600-d)M. \tag{11}$$

If initial time does not fall within these limits, the timer automatically adjusts its value to the nearest extreme, and playing speed is displayed accordingly. For time controls with Fischer or Bronstein delays, a delay is added to initial time in any case. Note that the variable d is constrained in both Formulas 9 and 11 by the necessity of initial time being nonnegative; consequently, Formula 9 does not apply to a time limit that has a delay greater than 1 second, which would yield a playing speed less than 60 moves per minute.

Minimum average playing speed for a sudden-death time limit comprising an entire game (Game/SD) in some embodiments is estimated from Formula 3 using 60 as a typical value for the number of moves, M. Estimated playing speed thus assumes that a game lasting 60 moves would take the full allotted time on each side, including delays. Actually, neither the time taken for an entire game nor the number of moves made on the board can be known in advance, but the calculation provides an estimate of the minimum average playing speed that is useful for purposes of comparison. As in the case of nonterminal playing speed, estimated playing speed may be restricted to a desired range, using the substitution of 60 moves for Min Formulas 9 and 11.

DRAWINGS—FIGURES

Figures are numbered in sequence. The numbering of details includes as a prefix the number of the figure in which they first appear. When a detail is identical to one in a previous embodiment, the same number is used. FIGS. 1 through 10 deal with the first embodiment, FIGS. 11 through 13 with the second embodiment, and FIGS. 14 through 16 with the third embodiment. Detail numbers are in bold face.

FIG. 1 provides a key for the flowchart symbols used in the drawings.

DETAILED DESCRIPTION—FIRST EMBODIMENT

Figure 1:
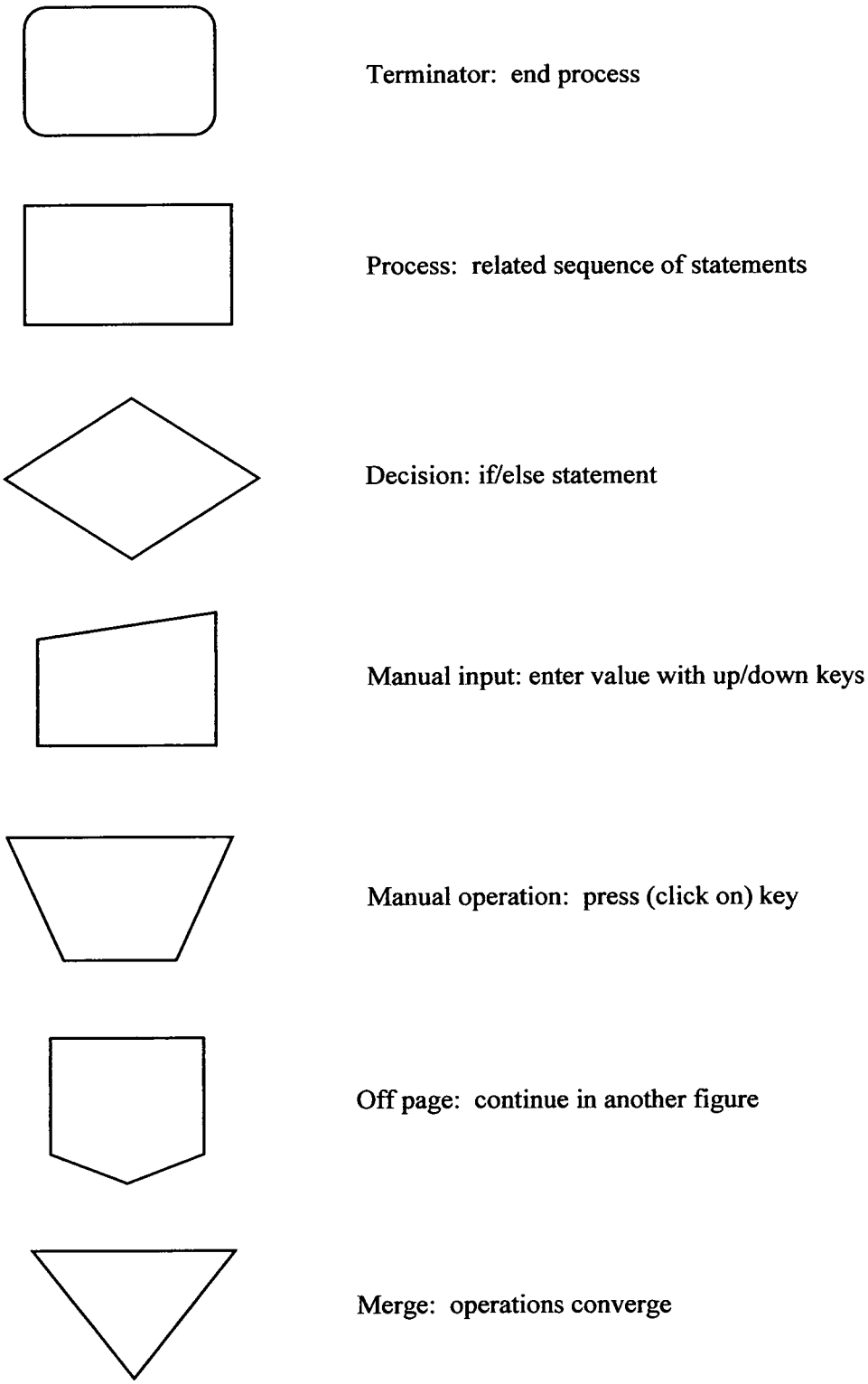
Figure 2:
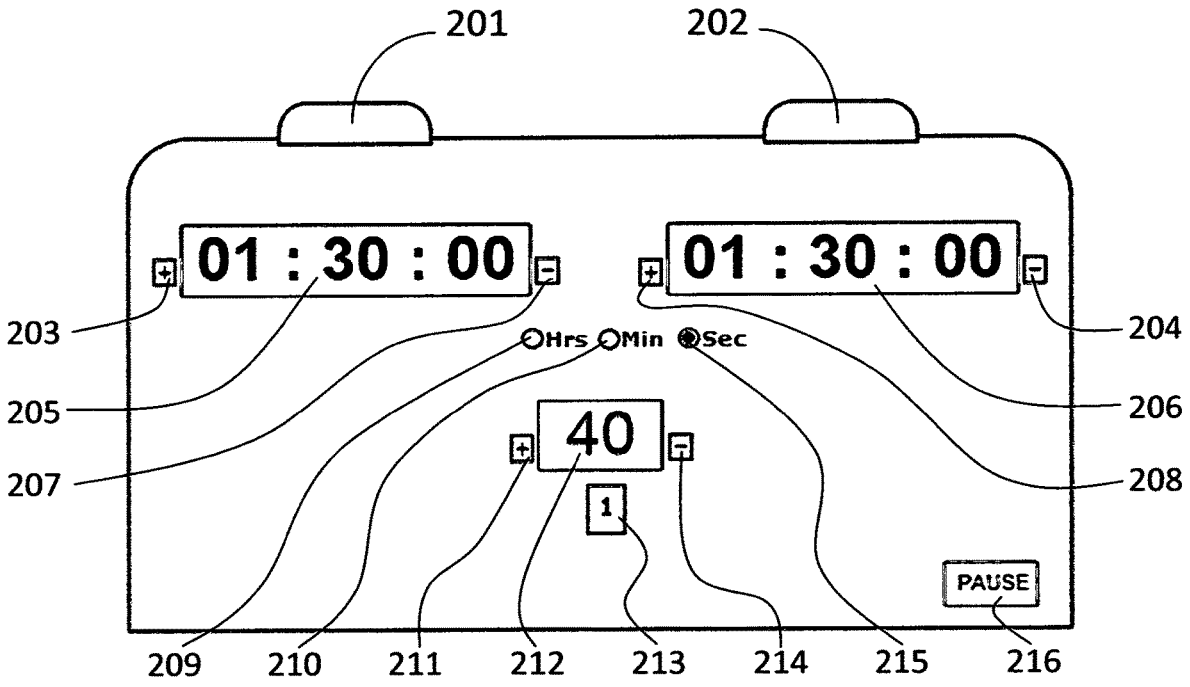
FIG. 2 represents the front of the timer in its first embodiment.

FIG. 2 shows a front view of the first embodiment. On the top of the timer are the move buttons (201, 202). The orientation of the timer with respect to White and Black depends on which move button is pressed first to start the game (the button used to start the game is on Black's side). The time remaining on each side is shown on the clocks (205, 206). The default initial values are shown as those of the official time limit of the International Chess Federation (FIDE). To the left of each clock is an increment button (203, 208), which increases time by hours, minutes, or seconds according to the selection buttons (209, 210, 215). The decrement buttons (207, 204) to the right of each clock similarly decrease time. A display (212) shows number of moves remaining in the current time control, or zero for sudden death. To the left of the number of moves is an increment button (211) and to the right is a decrement button (214). Below the number of moves is a smaller display (213) for the ordinal number of the current time control: primary, secondary, or tertiary. At the lower right is a Pause button (216) for temporarily suspending countdown and for enabling adjustment of values in exceptional conditions during play, such as official arbitration.

Figure 3:
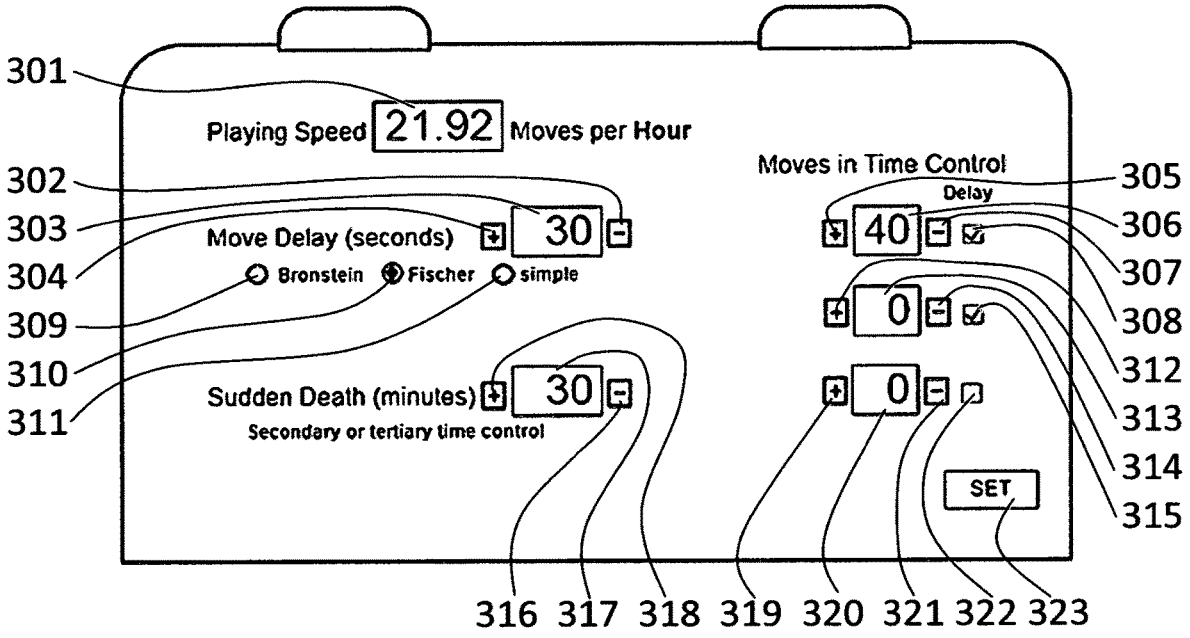
FIG. 3 represents the back of the timer in its first embodiment.

FIG. 3 shows the rear view of the first embodiment with the move buttons on top. A display (301) shows the minimum average playing speed, rounded to two decimal places. The word Hour in the label that follows alternates with the word Minute to reflect the unit of speed. Below playing speed is a display of the move delay (303) in seconds. To the left and right of the move delay are increment and decrement buttons respectively (304, 302). The type of delay used in the time limit is determined by selecting one of the three buttons (309, 310, 311) below the move delay. Further below is the display (317) of the time allotted for sudden death in minutes, also with increment and decrement buttons to the left and right (318, 316). This value applies only to sudden death in the secondary or tertiary time control. It does not apply to sudden death in the primary time control (Game/SD), where time allotted is determined from the front clocks (205, 206), in which case the value displayed for sudden death (317) is zeroed out.

To the right in FIG. 3 are the number of moves in each of the three time controls (306, 313, 320). To the left and right of each time control is an increment button and a decrement button: for the primary time control (305, 307); for the secondary time control (312, 314); and for the tertiary time control (319, 321). To the extreme right of each time control is a check box (308, 315, 322) for indicating whether or not the moves in the corresponding time control include the move delay (303). In the lower right hand corner of FIG. 3 is the Set button (323), which enables input when activated.

Operation—First Embodiment

Figure 4:
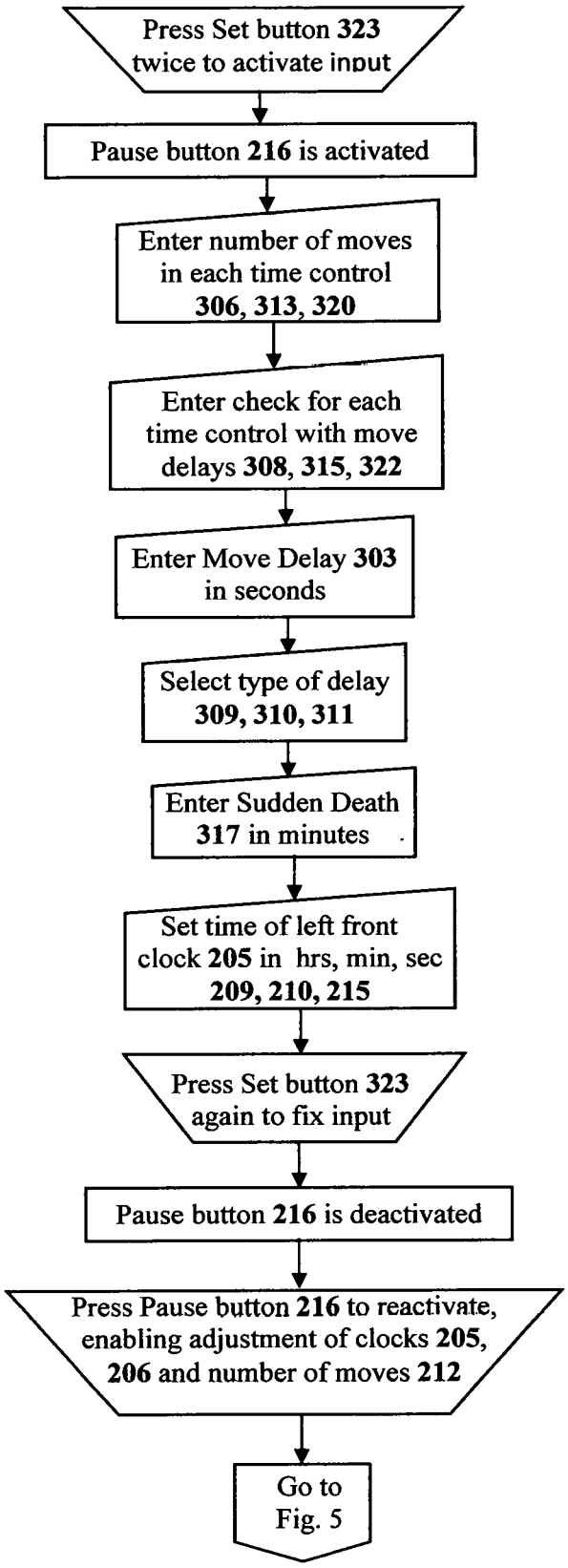
FIG. 4 is a flowchart representing the entry of inputs to the timer.

FIG. 4 shows the input process for setting up a specific time limit. It begins by pressing the Set button (323) twice within one second or a comparably short period of time. The double click is a preventive measure against accidental resets in the course of play. Activation of the Set button enables input. It is followed by automatic activation of the Pause button (216), which enables input on the front of the clock. There follows an optional set of manual inputs in which values on the front and back may be adjusted using the increment and decrement buttons associated with each value. The number of moves required for each time control (306, 313, 320) is entered. A zero value indicates a sudden-death time control, which effectively ends the series of time controls. Time controls subsequent to sudden death are zeroed out and ignored for purposes of calculation. The check boxes (308, 315, 322) to the extreme right of each time control are used to indicate which time controls, if any, will use the move delay (303) in each move of the corresponding time control. The delay (303) is entered and its type selected among the three possibilities (309, 310, 311). The number of minutes allotted for a sudden-death time control (317) occurring in the secondary or tertiary time controls (313, 320) is entered. If sudden death occurs in the primary time control (Game/SD), a zero value is entered into the display (317) and allotted time is taken from the front clocks (205,206). The starting time for a time limit is entered on the left front clock (205) in hours, minutes, and seconds, using the corresponding buttons (209, 210, 215), and is later copied to the right front clock (206) automatically. Finally, the Set button (323) is pressed again to fix input for subsequent calculations. The Pause button (216) is automatically deactivated, and the time limit is established. Modifications of the time limit after the Set button has been deactivated are made possible by reactivating the Pause button (216). While Pause is activated the clocks (205, 206) and the number of moves (212) can be adjusted. Such modifications are useful, for example, in reproducing the state of the timer at a previous adjournment. It is desirable that adjustment of moves be restricted to the range of possible values in the current time limit. For example, the range in a time control with 40 moves would be from 1 to 40. Decrementing the number of moves displayed as 1 would yield the number of moves in the next time control, and so forth.

Figure 5:
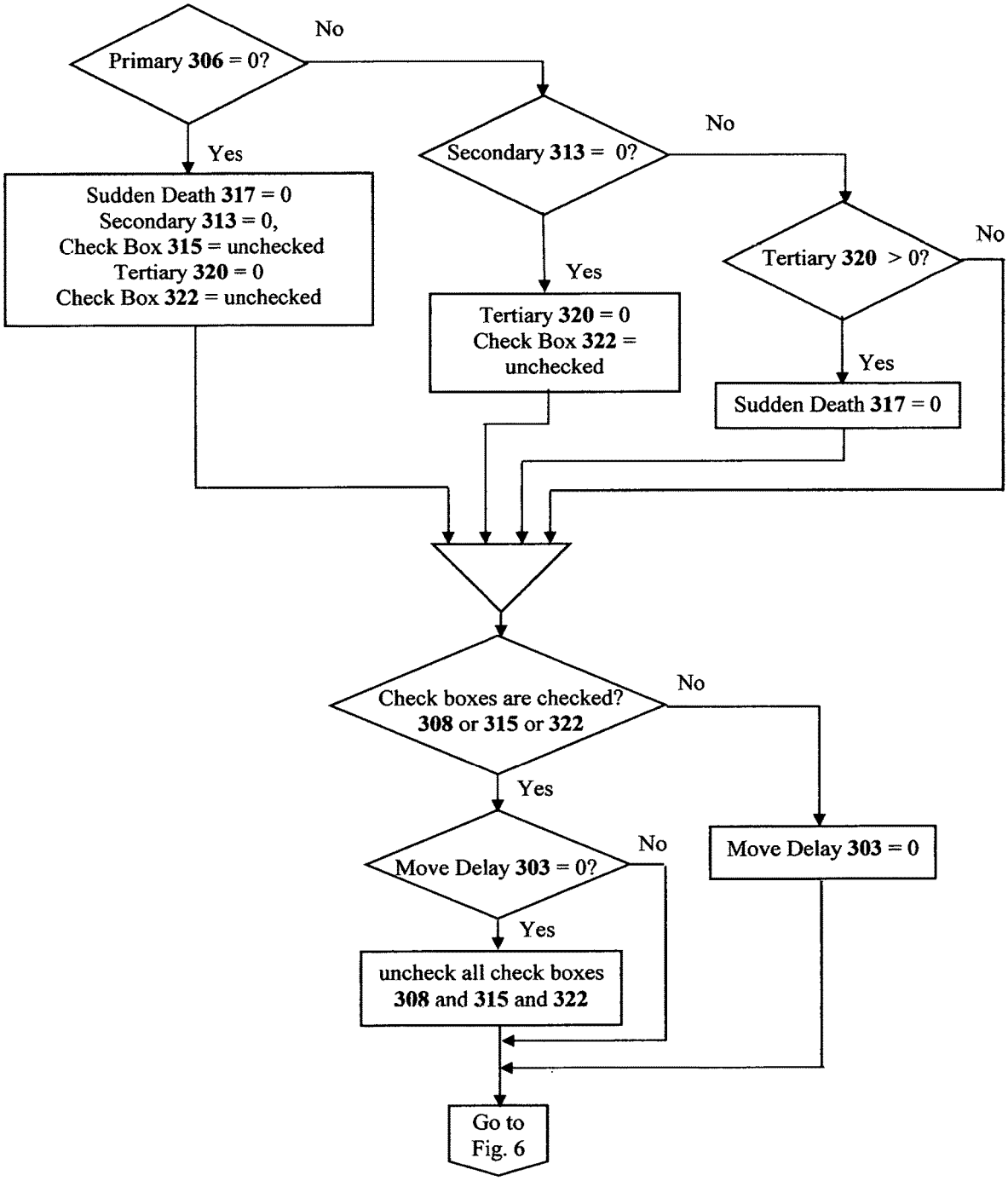
FIG. 5 is a flowchart representing initial processing of input, whereby extraneous values are made consistent with the time limit.
Figure 6:
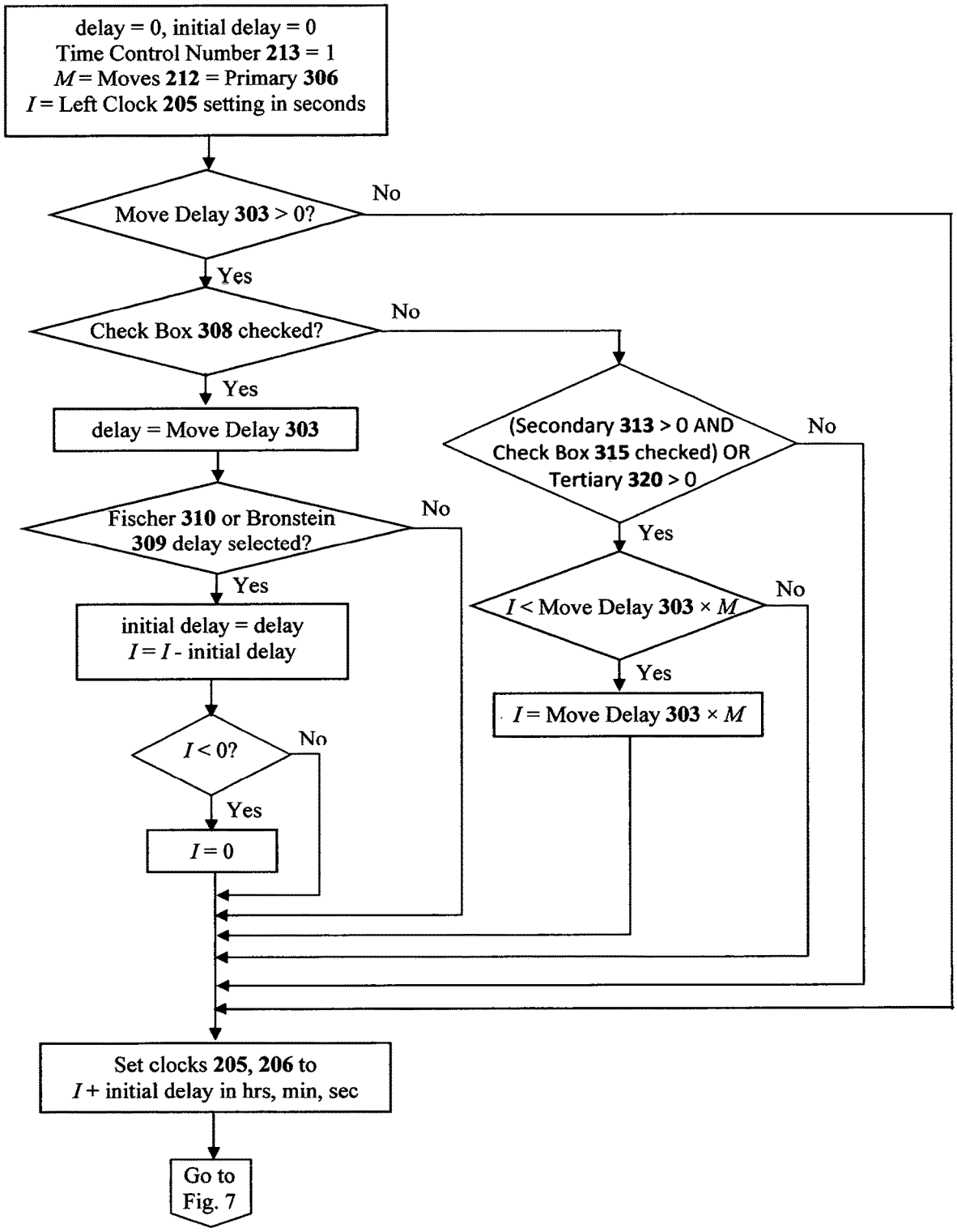
FIG. 6 is a flowchart representing further processing of input that establishes starting time.
Figure 7:
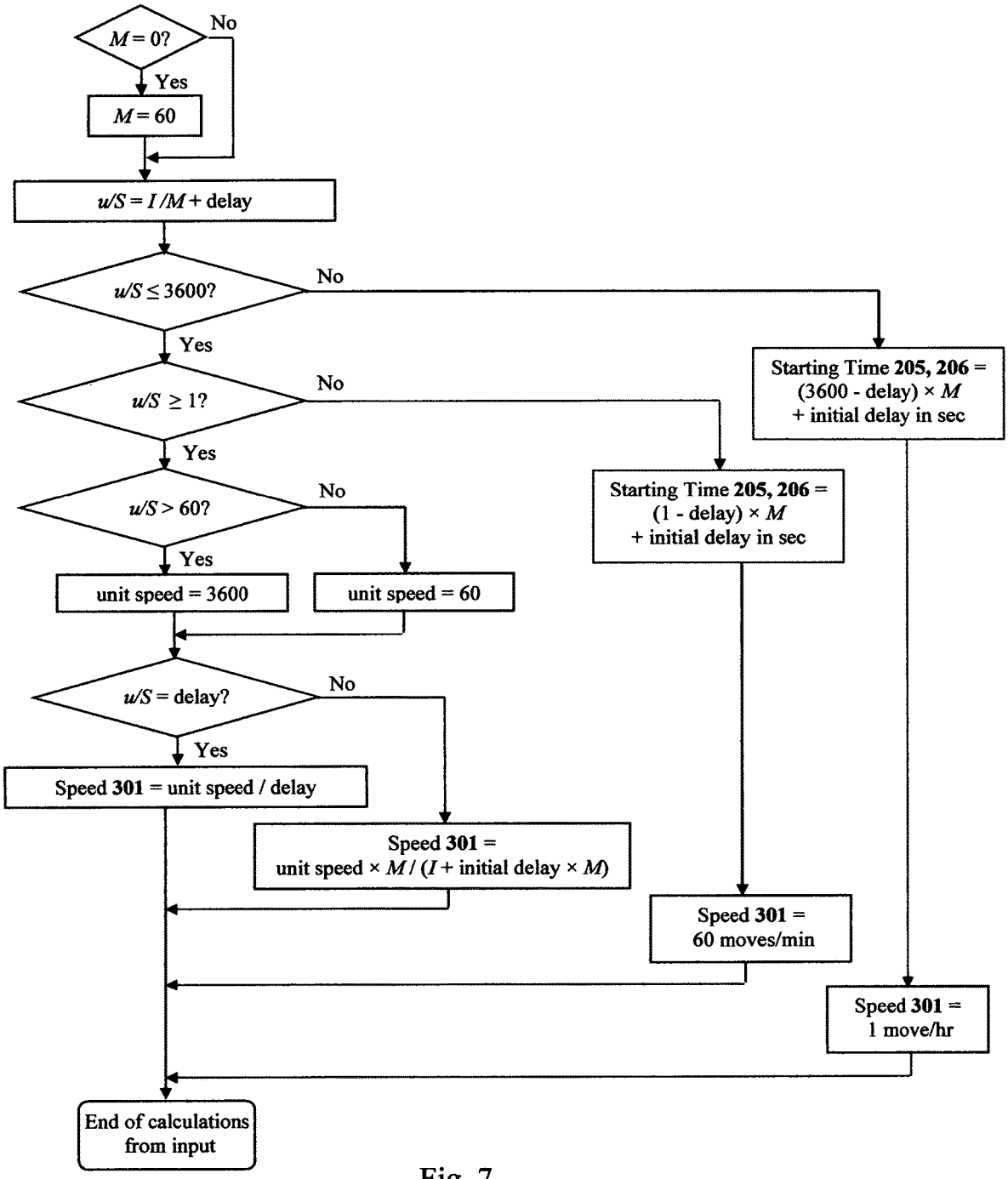
FIG. 7 is a flowchart representing final processing of input that establishes minimum average playing speed.

FIGS. 5 to 7 show the processing of input prior to starting a game.

In FIG. 5 a zero value for the number of moves in the primary time control (306) indicates a sudden-death game (Game/SD), which automatically zeroes out the display for sudden death (317) and the number of moves in the subsequent time controls (313, 320). The associated check boxes (315, 322) are unchecked. If instead the secondary time control (313) is a sudden-death control, the number of moves in the tertiary time control (320) is zeroed out and the associated check box (322) is unchecked. Finally, if the tertiary time control has a nonzero value for number of moves, there is no sudden-death control and the display for the allotted time in minutes (317) is zeroed out. All the tests for sudden death converge to a treatment of the check boxes associated with the time control. If none of the check boxes (308, 315, 322) is checked, the value for move delay (303) is automatically zeroed out; otherwise, if the move delay (303) already has a zero value, all check boxes (308, 315, 322) are unchecked. Note that all the processes in FIG. 5 are automatic but can be anticipated by manual settings. The automatic processes confirm the consistency of input.

In FIG. 6 several variables are first established: delay and initial delay are initialized to zero; Time Control Number (213) is set to 1 for the primary time control; M and the Number of Moves (212) are taken from the primary time control (306); and initial time in seconds, I, is taken from the left front clock (205). If the value displayed as Move Delay (303) is zero, there is no initial delay and the clocks (205, 206) remain at the initial time, I; if the value of Move Delay (303) is nonzero, the Check Box (308) of the primary time control is tested. If this check box is not checked, it may be necessary to adjust initial time, I, to avoid a negative value in subsequent time controls. If the nonzero delay applies to a secondary nonterminal time control (313) or if the tertiary time control (320) is nonterminal (no sudden-death controls), then I needs to be compared with the product Move Delay (303)×M. If I is less than the product, it is set equal to this product, and processing proceeds to setting the clocks (205, 206). Returning to the main flow, if the check box (308) is checked, the variable delay is set to the value of Move Delay (303). The type of delay is then tested. If the type is a Fischer (310) or Bronstein (309) delay, initial delay is set equal to delay and becomes a component of starting time. Initial time, I, is redefined by subtracting initial delay. If I thereby becomes negative, it is set to zero. All processes converge to a setting of the clocks (205, 206), converting starting time in seconds to hours, minutes, and seconds. Either I or initial delay may have a zero value; later processing precludes a zero value for both.

In FIG. 7, if the number of moves, M, in the primary time control is zero, indicating Game/SD, M is assigned the value 60 and playing speed is estimated by the calculations that follow. A convenient expression for inverse playing speed is then calculated as u/S from Equation 3. If u/S is greater than 3600, starting time (205, 206) is automatically recalculated using the maximum, and playing speed (301) is displayed at its minimum value. Similarly, if u/S is less than 1, starting time (205, 206) is automatically recalculated using the minimum, and playing speed (301) is displayed at its maximum value. If u/S is within its prescribed limits, it is then used to determine the unit of playing speed, per hour or per minute. If u/S is greater than 60, the unit of speed is 3600; otherwise, it is 60. Playing speed is then calculated by either of two methods. If u/S equals the delay value established in FIG. 6, then I equals zero by substitution into Equation 4, and substituting a zero value for I into Equation 3 gives a much reduced formula for playing speed (301). If u/S does not equal the delay, the full Equation 3 is used to calculate playing speed (301).

Figure 8:
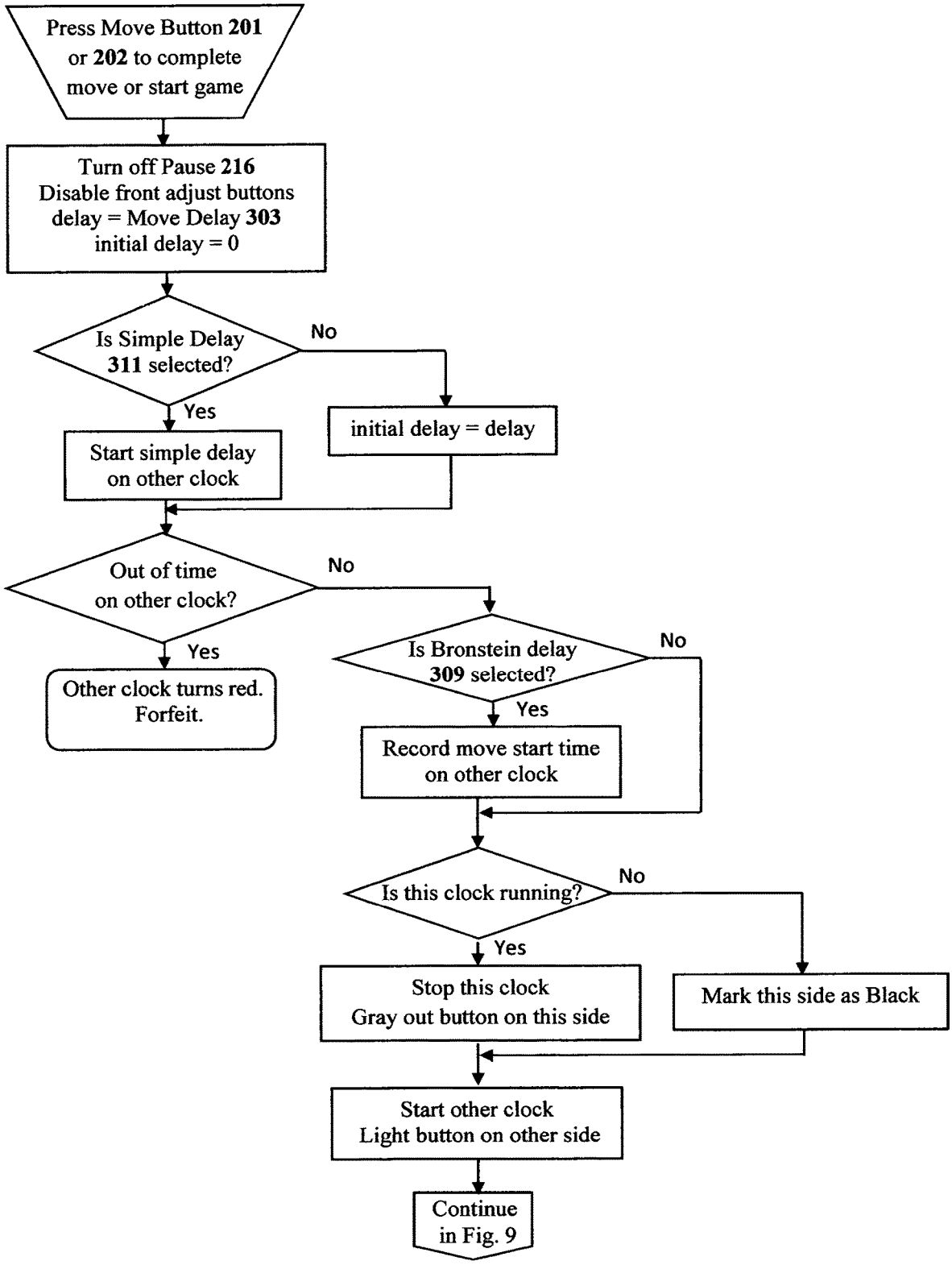
FIG. 8 is a flowchart representing the completion of a move, either at the start of timing or to transfer the countdown from one player to the other.
Figure 9:
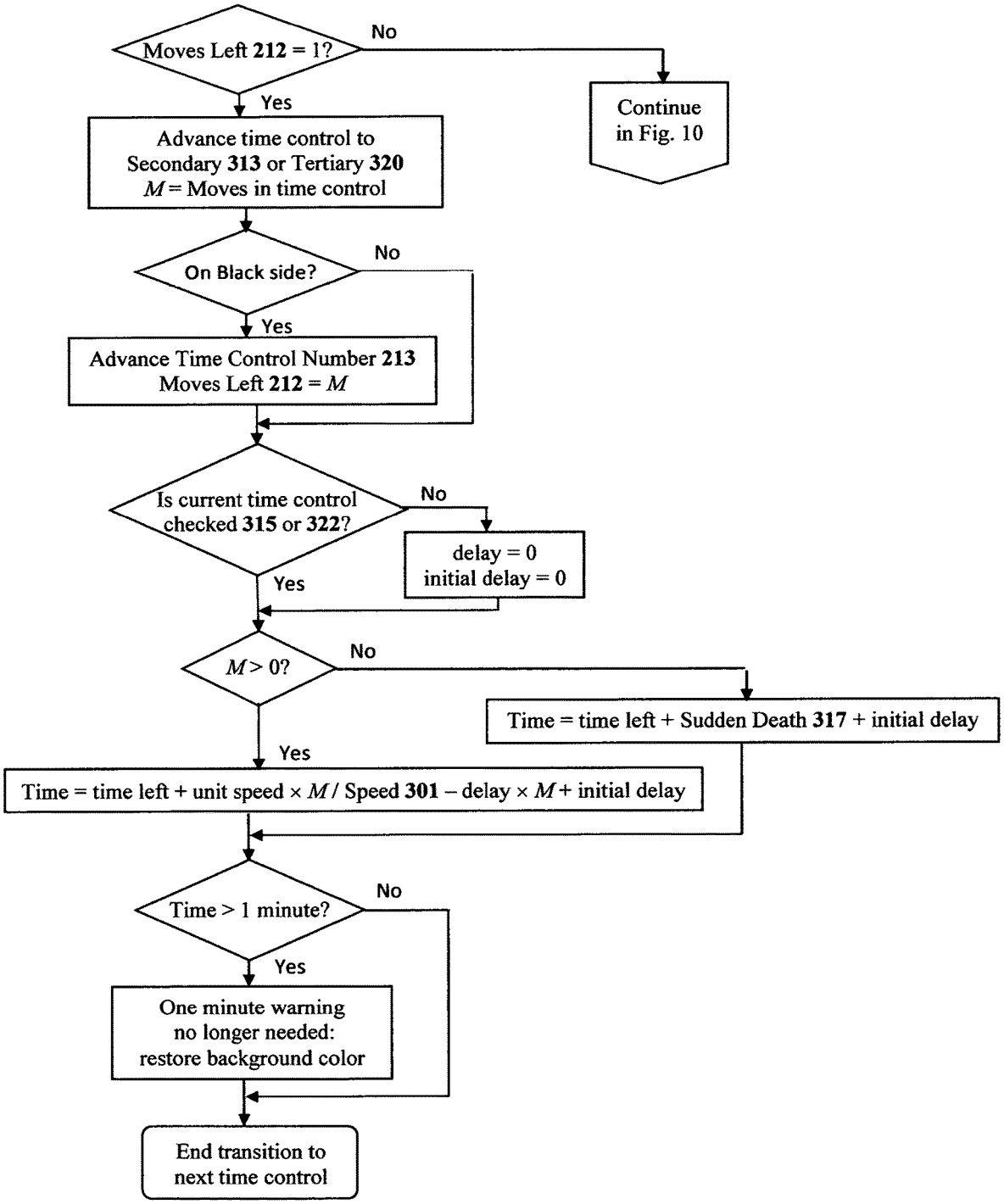
FIG. 9 is a flowchart representing completion of the final move of a nonterminal time control and the transition from one time control to the next.
Figure 10:
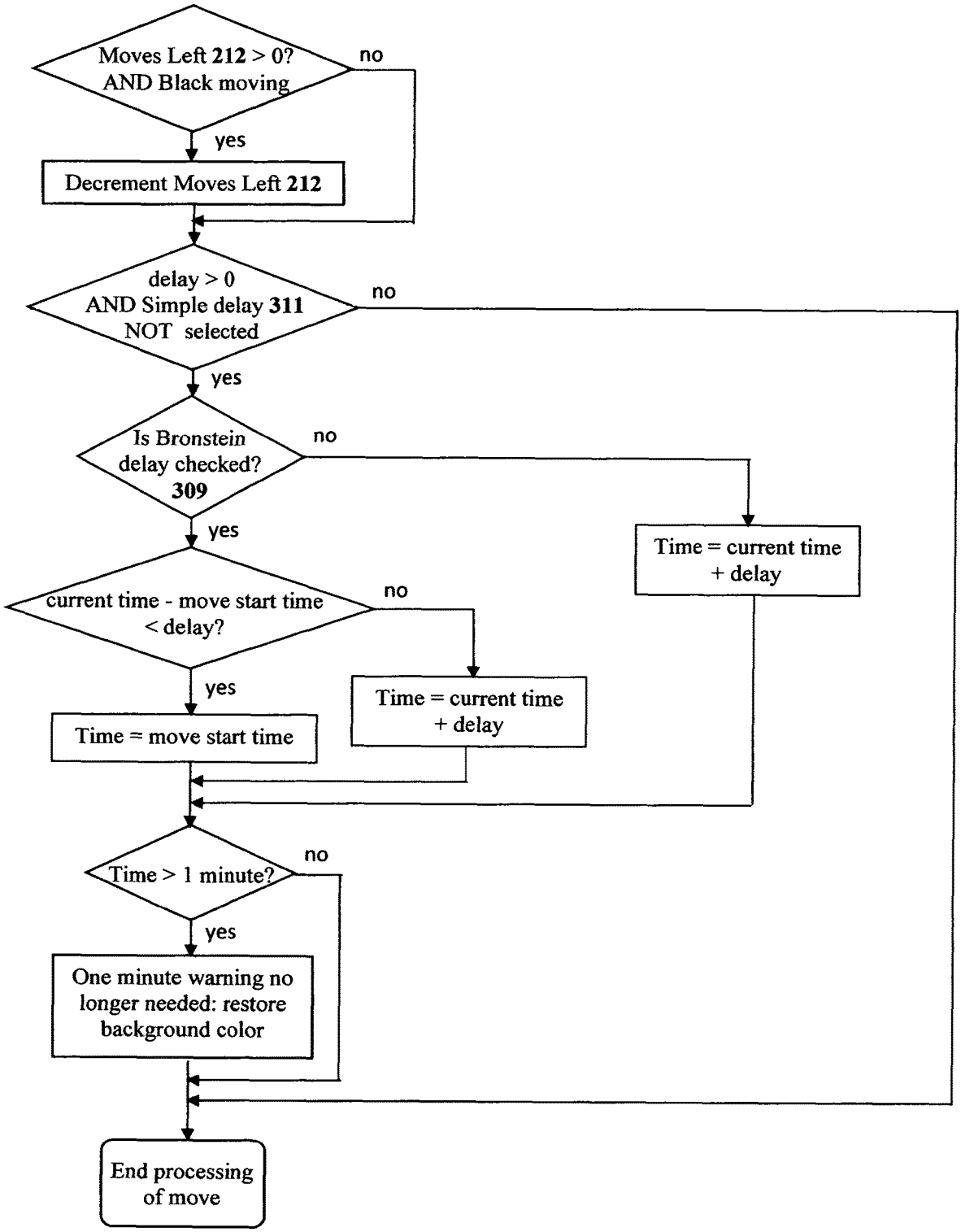
FIG. 10 is a flowchart representing completion of a move other than the final move in a nonterminal time control.

The remaining figures for the first embodiment, FIGS. 8 to 10, show processing after the completion of a move by either side.

In FIG. 8 a player presses the move button on his/her side (201, 202), which causes the Pause button (216) to be deactivated and disables the buttons on the front for incrementing and decrementing values. The delay variable is set to the value of Move Delay (303), and the initial delay variable is set to zero. If Simple Delay (311) has been selected, the delay begins on the other clock; otherwise, one of the other delay types has been selected, and initial delay is set to the value of delay. At this point, if the other clock is out of time, its background color turns red and the player on that side forfeits the game. Otherwise, if the Bronstein Delay (309) is selected, the start time of the move on the other clock is recorded. If the clock is running on the side whose button has been pushed, the clock is stopped and the pushed button is no longer lit; however, if the clock is not running, that side is simply recorded as having the black pieces. In any case, the other clock starts, and the button on that side lights up.

Continuing in FIG. 9, if the number of moves remaining is 1, the process of transition from one time control to the next begins; otherwise, processing proceeds in FIG. 10. With one move remaining the time control advances to the next control, Secondary (313) or Tertiary (320), and the variable M is assigned the number of moves in the new time control. The Tertiary control repeats if it was already in effect. In this embodiment there is only one display for moves remaining (212), which changes when Black completes a move. If Black completes the last move of a time control, its ordinal number (213) advances to 2 or 3 (or remains at 3) and the number of moves remaining (212) is displayed as M. If the current time control bears a check mark (315, 322), the delay and initial delay variables retain their current values; otherwise, they are set to zero. Now, if the number of moves Min the current time control is nonzero, time on the clock that was just stopped is calculated by Equation 4, adding time remaining and the initial delay. If the number of moves is zero, time is taken as the value displayed for Sudden Death (317), adding time remaining and the initial delay. If the transition to the new time control produces time on the stopped clock greater than one minute, any background color warning of a minute or less time remaining is restored to normal color.

In FIG. 10 it has already been determined that the number of moves remaining is not 1. The current time control may be either a nonterminal time control with more than one move remaining or a sudden-death time control indicated by zero moves. In the case of a nonterminal control, the number of moves remaining (212) is decremented by one if Black completes the move. Then, if the delay is zero, or if the type of delay is simple (311), further processing of the move is not needed. If the type of delay is Bronstein (309), the difference between the current (stopped) time and the start time of the move is compared with the nonzero delay. If the difference is less than the delay, clock time reverts to the time at start of the move; otherwise, the delay is added to the stopped clock time. If the type of delay is Fischer (310), the only remaining option, the delay is added to the stopped clock time. Finally, if the resulting time exceeds one minute, the background color of the stopped clock is restored (or redundantly maintained). With a simple delay, time is not added to the clock, and the one-minute warning, if it is in effect, remains.

DETAILED DESCRIPTION—SECOND EMBODIMENT

Figure 11:
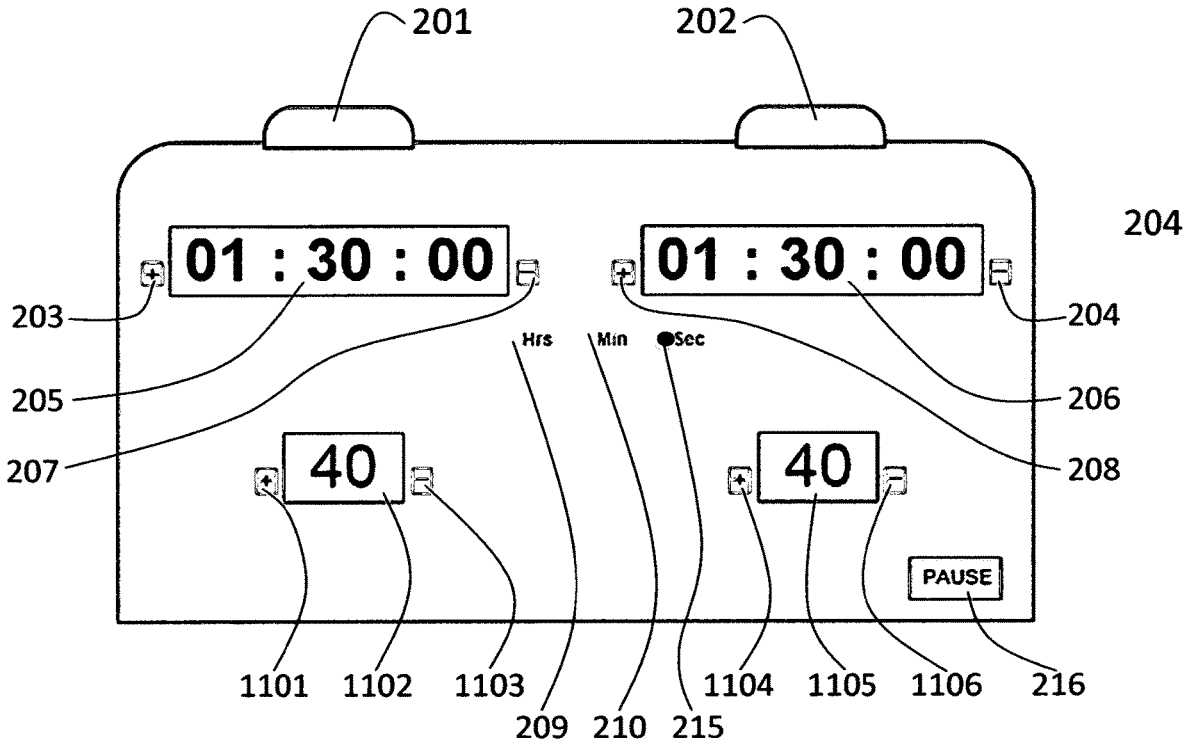
FIG. 11 represents the front of the timer in the second embodiment.

FIG. 11 shows the front view of the second embodiment. The back view is identical to that of the first embodiment. The second embodiment differs from the first in having separate displays (1102, 1105) for the number of moves remaining on each side. This has a slight advantage in accuracy since with a single display the number of moves remaining for White is updated only when Black completes his/her move. A further difference is that the second embodiment has no display for the ordinal number of the current time control. The number of moves remaining (1102, 1105) can be adjusted while pause (216) is activated, using the increment button (1101, 1104) to the left of each display and the decrement button (1103, 1106) to the right.

Operation—Second Embodiment

Figure 12:
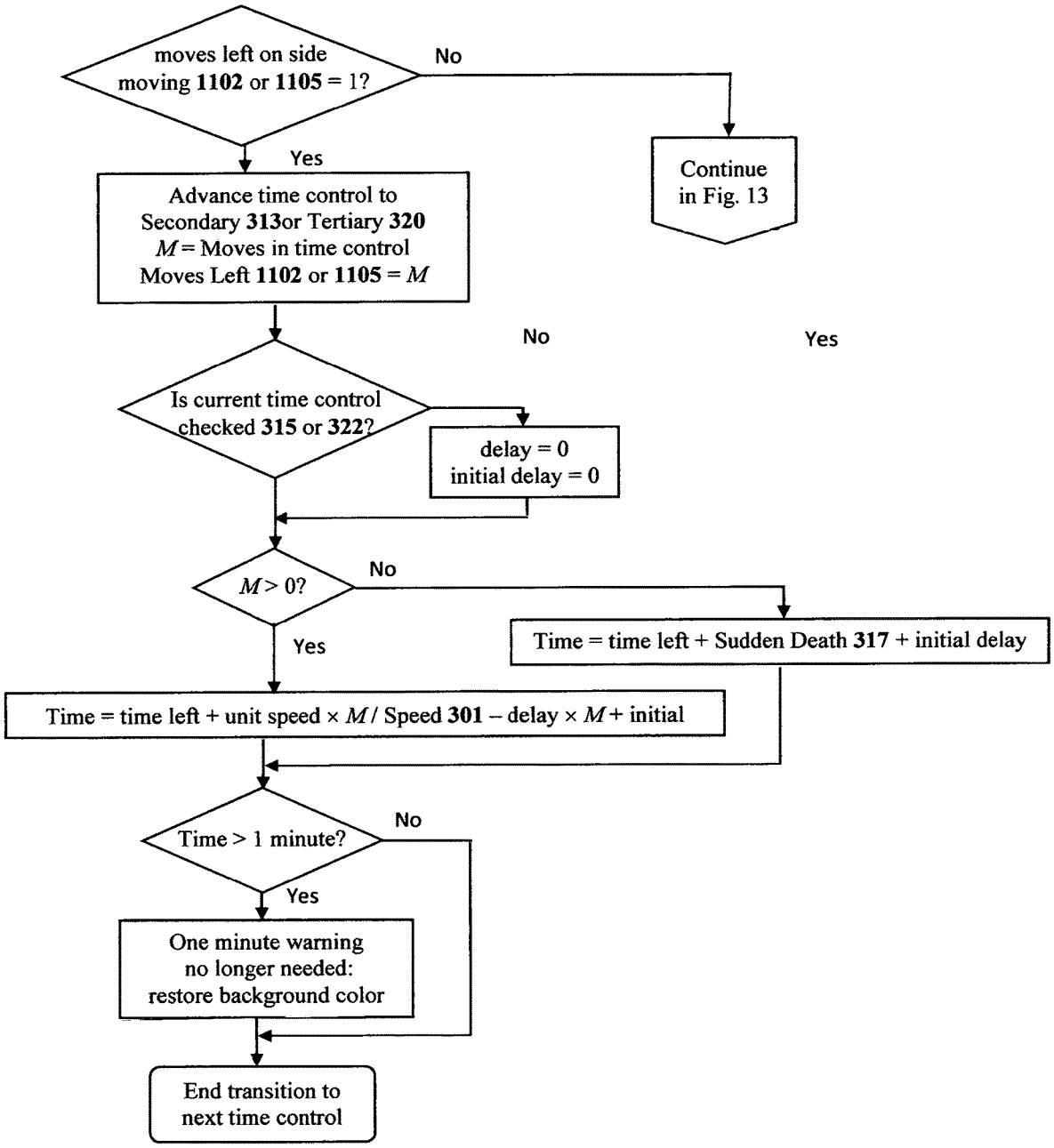
FIG. 12 is a flowchart incorporating changes from the second embodiment into FIG. 9.

FIG. 12 shows the transition from one time control to the next when a move button is pushed with one move remaining in the current time control, as displayed (1102, 1105) on the side completing the move. If there is more than one move remaining or zero moves, processing continues in FIG. 13. As the designations of FIG. 3 apply equally well to the second embodiment, the time control advances from the primary (306) to the secondary (313) or from the secondary to the tertiary (320), or the tertiary control repeats itself indefinitely. The number of moves in the new time control is assigned to the variable M and displayed on the side completing the move (1102, 1105). Processing then proceeds to a consideration of whether or not the new control is checked (315, 322), and the rest of FIG. 12 is identical to FIG. 9.

Figure 13:
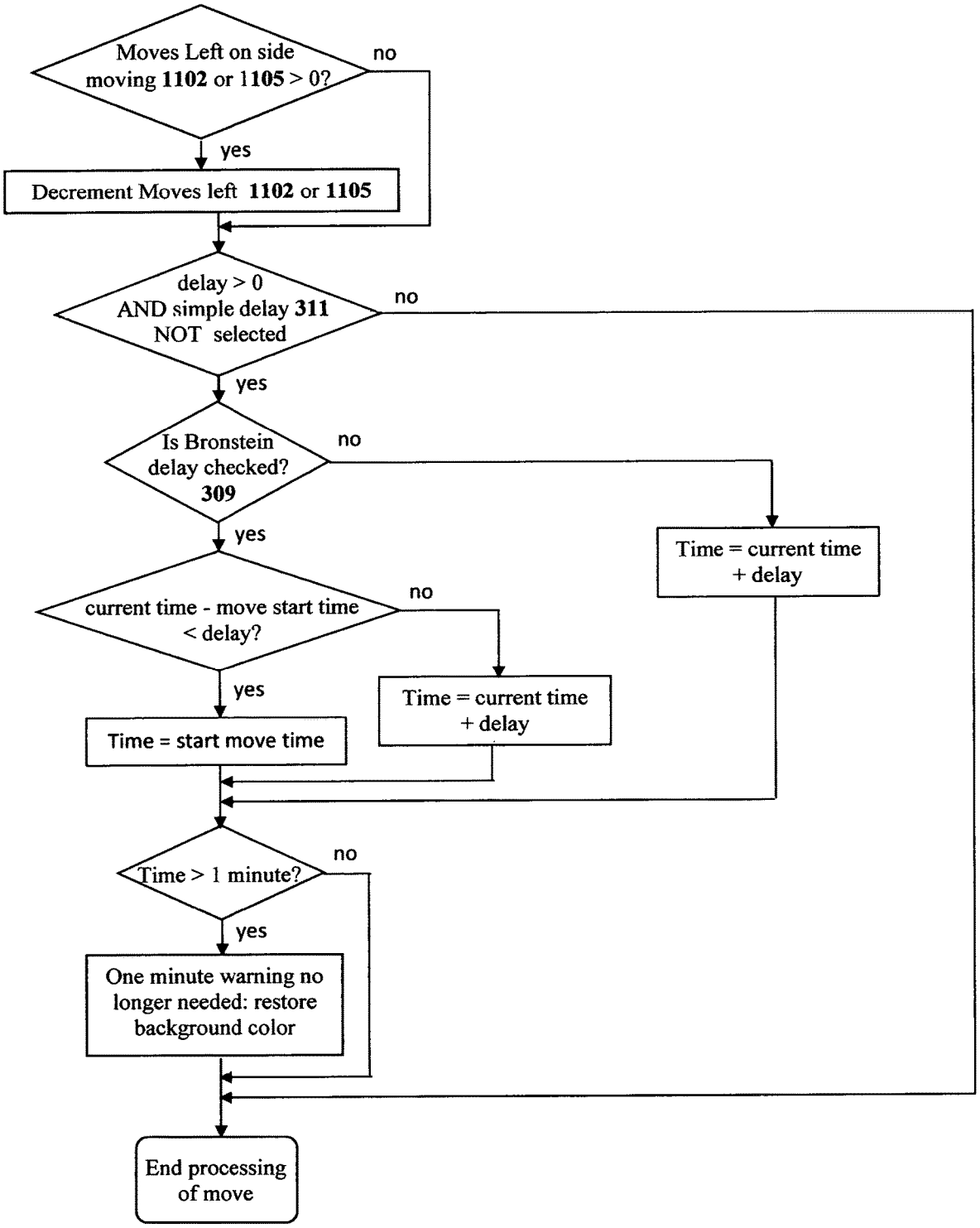
FIG. 13 is a flowchart incorporating changes from the second embodiment into FIG. 10.

FIG. 13 shows the completion of processing for a move other than the final move of a nonterminal time control. Most of the processing is identical to that of FIG. 10. If the number of moves remaining (1102, 1105) on the side completing the current move is greater than zero, that number is decremented by one; otherwise, the new time control is a sudden-death control, and the number remains at zero.

DETAILED DESCRIPTION—THIRD EMBODIMENT

Figure 14:
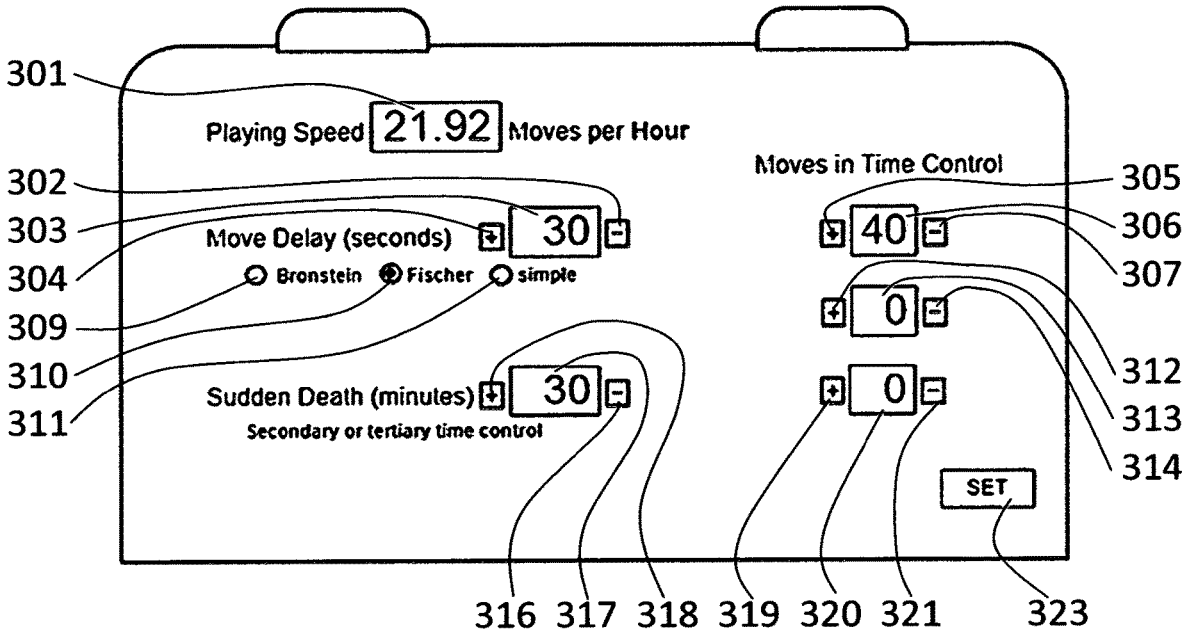
FIG. 14 represents the back of the timer in the third embodiment.

FIG. 14 shows the back of the timer for the third embodiment. The details are the same as in FIG. 3 except for the absence of checkboxes next to the time controls. Numbering of the details otherwise corresponds to that of FIG. 3.

Operation—Third Embodiment

Figure 15:
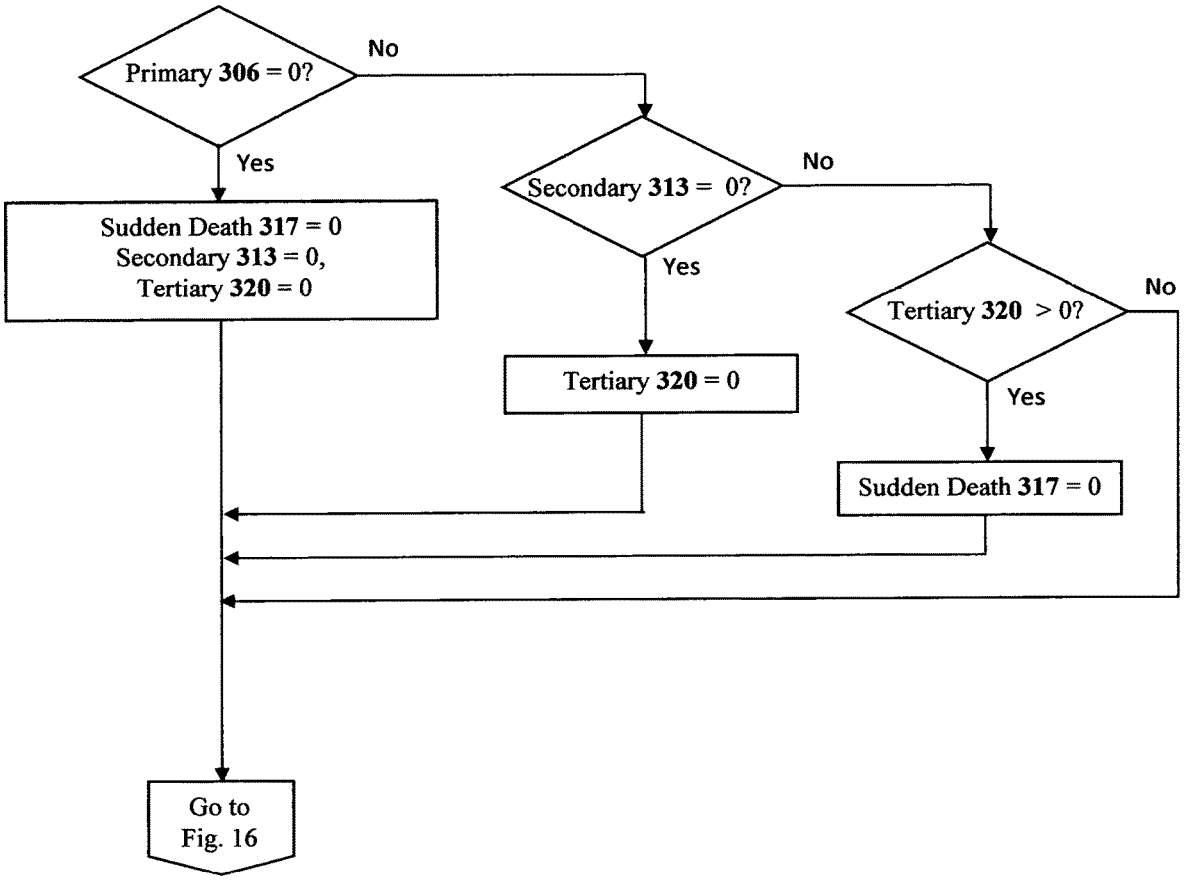
FIG. 15 is a flowchart incorporating changes from the third embodiment into FIG. 5.

FIG. 15 shows processing of input prior to start of a game, corresponding to the operations of FIG. 5, but much simplified. If the primary control (306) shows zero moves, indicating sudden death for the entire time limit, the allotted time is taken from input starting time (205), and Sudden Death (317) is set to zero; the secondary (313) and tertiary (320) time controls are set to zero. If the primary control (306) is nonzero and the secondary control (313) is zero, the tertiary control (320) is set to zero. Finally, if all three time controls are nonzero, sudden death does not apply in the time limit, and Sudden Death (317) is set to zero.

Figure 16:
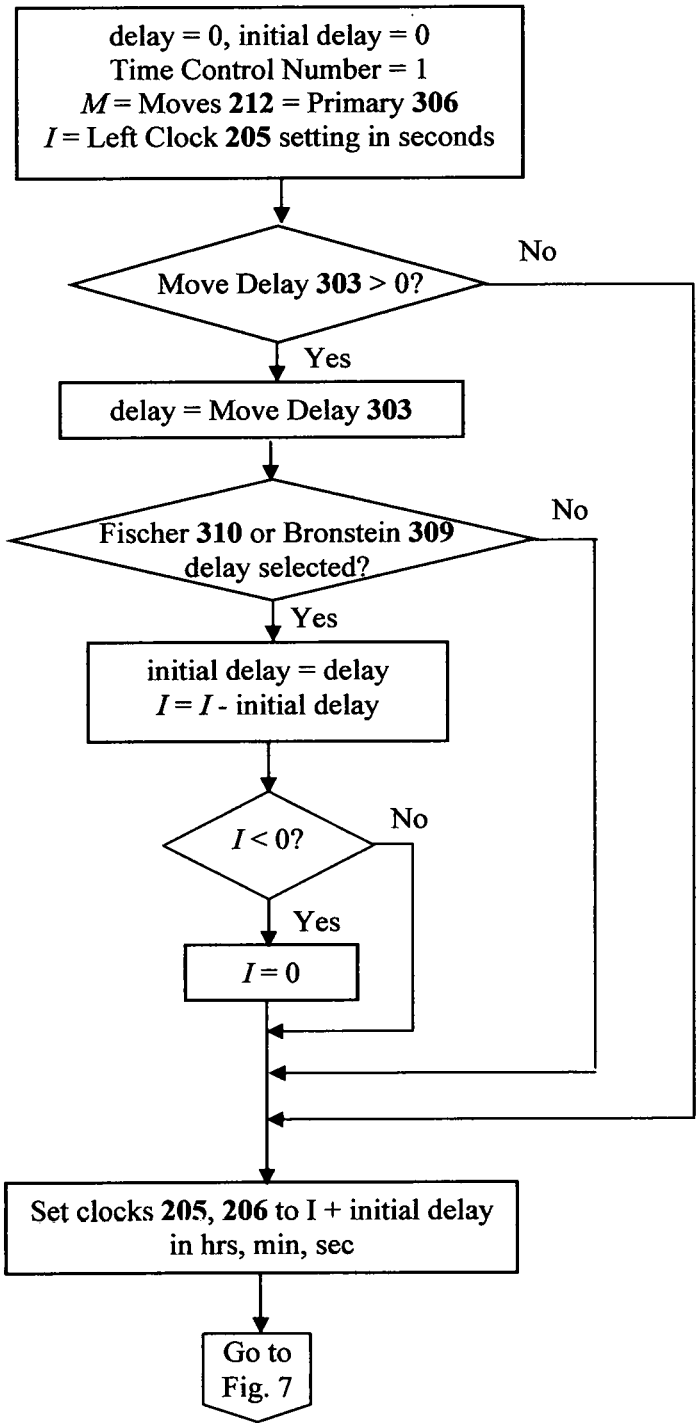
FIG. 16 is a flowchart incorporating changes from the third embodiment into FIG. 6.

FIG. 16 shows further processing of input. The operations largely correspond to those of FIG. 6, but the error condition that sometimes arises when the primary time control is unchecked cannot occur. After initialization of variables for delay and initial delay, the Time Control Number is set to 1. The number of moves remaining (212) is set from the number in the primary control (306), and the variable M is assigned this number. The variable I is set to the time of the left clock (205) in seconds. As in FIG. 6, if the Move Delay (303) is zero, no further processing is required to establish starting time; otherwise, the delay variable is assigned the value of Move Delay (303) and remains constant over the time limit. It is then determined whether the Fischer Delay (310) or the Bronstein Delay (309) has been selected, and operations proceed thereafter as in FIG. 6.

CONCLUSION, RAMIFICATIONS, AND SCOPE

Accordingly, it will be seen that the calculation and display of minimum average playing speed provides not only a valuable service to users of game timers, but a service that goes to the essential purpose of a game timer, that is, to enforce reasonable playing speeds in competition. The various delays that have come into use with modern digital chess clocks are generally viewed as means of overcoming the restrictions of time limits and avoiding time scrambles. It has not been recognized that timing delays actually represent a modification of time limits that can be mathematically represented. The various embodiments of the game timer herein described provide an accurate representation of playing speed that would be useful to players, game officials, and enthusiasts in gauging quality of play and stresses imposed by competitive conditions.

In addition to accurate calculation of minimum average playing speed, the description above includes most of the features found in modern digital chess clocks. These should not be construed as limiting the scope of the embodiment but merely as providing illustrations of its possibilities. For example: (1) Some chess clocks do not have the option of choosing which time controls include a delay for each of their moves; a delay applies either to all the time controls or to none. This would not affect the calculation of minimum average playing speed, as the variable d in the above formulas would simply become constant over a time limit. (2) A chess clock can be fashioned to implement only one type of delay, for example, a Fischer Clock that applies the Fischer delay in a sudden-death time limit. The estimate of playing speed would be essentially no different from the treatment in the embodiment described above; all of the variables required for such an estimate are available. (3) Similarly, time controls can be added or omitted without changing the principles of operation. As in the embodiments described, the minimum average playing speed for any number of time controls would be the same (with the exception of a sudden-death time control); without a sudden-death time control the final time control in the series would similarly be repeated.

(4) In the embodiment described above, error conditions (i. e., impractical configurations, such as negative starting time) are dealt with by an automatic adjustment of starting time. Other embodiments may take other measures, for example, adjustment of other variables or display of a warning. (5) The precision of minimum average playing speed as displayed is another aspect that may vary from one embodiment to another. A reasonable precision for purposes of comparison is in hundredths of a move per unit time, but this does not preclude other expressions of playing speed. (6) Embodiments may reasonably vary in their display of the number of moves remaining in a time control, even to the extent of not displaying the number at all since keeping track of the number of moves remaining has traditionally been the responsibility of players. (7) The ability to adjust values after the configuration of a time limit, particularly clock time and number of moves remaining, is convenient for arbitration or emergencies but is not an essential aspect of these embodiments.

Although the description above contains many specificities, these should not be construed as limiting the scope of the embodiment but merely providing illustrations of some of the presently preferred embodiments. For example, the switches that control stopping and starting of the clocks may be of various kinds, such as membrane switches, toggle switches, lever switches, touch sensors, etc. The switches may control the clocks by various means, such as by mechanical action, electronic circuits, optical beams, or remote control signals. A single switch may control both stopping and starting a single clock, or two clocks in alternation. The time displays may be in various configurations of hours, minutes, and seconds, which may vary in the course of a game, and the speed of the countdown may be in seconds, tenths of a second, hundredths of a second, etc. The input mechanisms may be of various sorts, including buttons, knobs, sliders, voice activation, etc.

Thus the scope of the embodiment should be determined by the appended claims and legal equivalents, rather than by the examples given.

I claim:

1. An electronic timer for calculating from inputs, displaying, and enforcing minimum average playing speed for each of two alternating sequences of events, including:

(a) a pair of clock means for displaying the starting time for each of said sequences, (b) a pair of switches coupled to said clock means, each of which starts one of said clock means and simultaneously stops the other of said clock means, whereby the time remaining for each of said sequences is recorded and displayed, (c) a sequence of one or more event handlers, coupled to said switches and to said clock means, for input, storage, and display of a variable number of events assigned respectively to said event handlers and representing the number of events in a subsequence of said alternating sequences of events, (d) a sequence of one or more delay handlers, coupled respectively to said event handlers, for input, storage, and display of a variable delay associated with each of said subsequences, whereby said delay may be added to time taken by each of said events in said subsequence, (e) a speed handler, connected to said delay handlers, for calculating and displaying said minimum average playing speed over the first of said subsequences as number of events per unit time, taking into account the number of said events in said subsequence, said starting time, and said delay.

2. The electronic timer of claim 1 further including a time handler, coupled to said speed handler, for calculating and displaying an initial period of time consistent with said minimum average playing speed for each nonterminal subsequence of said subsequences after the first of said subsequences, whereby said minimum average playing speed is the same for each of said nonterminal subsequences.

3. The time handler of claim 2 further including means for adding to the initial time of each of said subsequences time remaining from the previous subsequence of said subsequences, whereby said minimum average playing speed applies over all completed nonterminal subsequences.

4. The electronic timer of claim 1 further including a terminal subsequence handler for input, storage, and display of a period of time assigned to a terminal subsequence in each of said alternating sequences, whereby the initial time for said terminal sequence can be determined from said period of time, delays applied by said delay handlers, and time remaining from previous subsequences.

5. The event handlers of claim 1 further including means for repeating the number of events, delay, and calculated time of the last nonterminal subsequence in each of said alternating sequences in the absence of a terminal subsequence, whereby said minimum average playing speed can be applied over said alternating sequences indefinitely.

6. The delay handlers of claim 1 including means for input, storage, and display of a marker for each of said subsequences respectively, denoting whether to add said delay to the time taken by each event of said subsequence, whereby the total time allowed for each of said subsequences and said minimum average playing speed may be calculated.

7. The electronic timer of claim 1 in which said speed handler applies to each of said alternating sequences as a single terminal subsequence and in which said speed handler estimates and displays minimum average playing speed over said terminal subsequence, taking into account a typical number of said events for an entire game, said starting time, and said delay.

8. An electronic timer for timing two alternating sequences of events, including:

(a) a pair of clock means for displaying the starting time for each of said sequences, (b) a pair of switches coupled to said clock means, each of which starts one of said clock means and simultaneously stops the other of said clock means, whereby the time remaining for each of said sequences is recorded and displayed, (c) a sequence of one or more event handlers, coupled to said switches and to said clock means, for input, storage, and display of a variable number of events assigned respectively to said event handlers and representing the number of events in a subsequence of said alternating sequences of events, (d) a sequence of one or more delay handlers, coupled respectively to said event handlers, for input, storage, and display of a variable delay associated with each of said subsequences, whereby said delay may be added to time taken by each of said events in said subsequence, further including means for selecting by input a type of said delay from a displayed plurality of delay types, including Bronstein, Fischer, and simple delays, whereby said delay can be uniformly treated as coming before the event of said subsequence to which it applies, thereby avoiding loss of said delay at the end of said subsequence in the case of a Bronstein or Fischer delay;

(e) a speed handler, connected to said delay handlers, for calculating and displaying minimum average playing speed over the first of said subsequences as number of events per unit time, taking into account the number of said events in said subsequence, said starting time, and said delay.

9. An electronic timer for timing two alternating sequences of events, including:

(a) a pair of clock means for displaying the starting time for each of said sequences, (b) a pair of switches coupled to said clock means, each of which starts one of said clock means and simultaneously stops the other of said clock means, whereby the time remaining for each of said sequences is recorded and displayed, (c) a sequence of one or more event handlers, coupled to said switches and to said clock means, for input, storage, and display of a variable number of events assigned respectively to said event handlers and representing the number of events in a subsequence of said alternating sequences of events, (d) a sequence of one or more delay handlers, coupled respectively to said event handlers, for input, storage, and display of a variable delay associated with each of said subsequences, whereby said delay may be added to time taken by each of said events in said subsequence, (e) a speed handler, connected to said delay handlers, for calculating and displaying minimum average playing speed over the first of said subsequences as number of events per unit time, taking into account the number of said events in said subsequence, said starting time, and said delay, (f) a pause button controlling a pause mechanism, connected to said clock means and to said pair of switches, whereby said pause mechanism (a) causes said clock means to pause if said pause button is turned on while a game is in progress, allowing adjustment of the timer;

(b) causes input on the front of the timer to be enabled if said pause mechanism is activated while a game is not in progress;

(c) causes input values to be fixed in preparation for calculation of minimum average playing speed if said pause mechanism is deactivated while a game is not in progress.

10. An electronic timer for timing two alternating sequences of events, including:

(a) a pair of clock means for displaying the starting time for each of said sequences, (b) a pair of switches coupled to said clock means, each of which starts one of said clock means and simultaneously stops the other of said clock means, whereby the time remaining for each of said sequences is recorded and displayed, (c) a sequence of one or more event handlers, coupled to said switches and to said clock means, for input, storage, and display of a variable number of events assigned respectively to said event handlers and representing the number of events in a subsequence of said alternating sequences of events, (d) a sequence of one or more delay handlers, coupled respectively to said event handlers, for input, storage, and display of a variable delay associated with each of said subsequences, whereby said delay may be added to time taken by each of said events in said subsequence, (e) a speed handler, connected to said delay handlers, for calculating and displaying minimum average playing speed over the first of said subsequences as number of events per unit time, taking into account the number of said events in said subsequence, said starting time, and said delay, (f) a set/reset mechanism coupled to a toggle button for enabling and disabling input, whereby said set/reset mechanism (a) displays preset input values when said electronic timer is turned on;

(b) enables input and resets said input values in the course of play to their last set values when said toggle button is turned on;

(c) disables input and fixes said input values for calculation when said toggle button is turned off.

11. An electronic timer for timing two alternating sequences of events, including:

(a) a pair of clock means for displaying the starting time for each of said sequences, (b) a pair of switches coupled to said clock means, each of which starts one of said clock means and simultaneously stops the other of said clock means, whereby the time remaining for each of said sequences is recorded and displayed, (c) a sequence of one or more event handlers, coupled to said switches and to said clock means, for input, storage, and display of a variable number of events assigned respectively to said event handlers and representing the number of events in a subsequence of said alternating sequences of events, (d) a sequence of one or more delay handlers, coupled respectively to said event handlers, for input, storage, and display of a variable delay associated with each of said subsequences, whereby said delay may be added to time taken by each of said events in said subsequence, (e) a speed handler, connected to said delay handlers, for calculating and displaying minimum average playing speed over the first of said subsequences as number of events per unit time, taking into account the number of said events in said subsequence, said starting time, and said delay, (f) a set/reset mechanism coupled to a toggle button for enabling and disabling input, including means whereby starting time in the first of said subsequences is automatically adjusted if preliminary calculation from said input when said toggle button is turned off causes starting time in any of said subsequences to go negative, whereby said set/reset mechanism (a) displays preset input values when said electronic timer is turned on;

(b) enables input and resets said input values in the course of play to their last set values when said toggle button is turned on;

(c) disables input and fixes said input values for calculation when said toggle button is turned off.

12. An electronic timer for timing two alternating sequences of events, including:

(a) a pair of clock means for displaying the starting time for each of said sequences, (b) a pair of switches coupled to said clock means, each of which starts one of said clock means and simultaneously stops the other of said clock means, whereby the time remaining for each of said sequences is recorded and displayed, (c) a sequence of one or more event handlers, coupled to said switches and to said clock means, for input, storage, and display of a variable number of events assigned respectively to said event handlers and representing the number of events in a subsequence of said alternating sequences of events, (d) a sequence of one or more delay handlers, coupled respectively to said event handlers, for input, storage, and display of a variable delay associated with each of said subsequences, whereby said delay may be added to time taken by each of said events in said subsequence, (e) a speed handler, connected to said delay handlers, for calculating and displaying minimum average playing speed over the first of said subsequences as number of events per unit time, taking into account the number of said events in said subsequence, said starting time, and said delay, (g) a set/reset mechanism coupled to a toggle button for enabling and disabling input, including means whereby starting time in the first of said subsequences is automatically adjusted if preliminary calculation from said input when said toggle button is turned off causes minimum average playing speed to fall below a preset minimum parameter or to exceed a preset maximum parameter, whereby said set/reset mechanism (a) displays preset input values when said electronic timer is turned on;

(b) enables input and resets said input values in the course of play to their last set values when said toggle button is turned on, (c) disables input and fixes said input values for calculation when said toggle button is turned off.

* * * * *